US011746645B2

(12) United States Patent
Vittal et al.

(10) Patent No.: US 11,746,645 B2
(45) Date of Patent: Sep. 5, 2023

(54) SYSTEM AND METHOD FOR RESERVOIR MANAGEMENT USING ELECTRIC SUBMERSIBLE PUMPS AS A VIRTUAL SENSOR

(71) Applicant: Baker Hughes ESP, Inc., Houston, TX (US)

(72) Inventors: Sameer Vittal, Atlanta, GA (US); Renee He, Atlanta, GA (US); Mark Andrew Sporer, Greenville, SC (US); Michael Franklin Hughes, Oklahoma City, OK (US)

(73) Assignee: GE Oil & Gas ESP, Inc., Houston, TX (US)

( * ) Notice: Subject to any disclaimer, the term of this patent is extended or adjusted under 35 U.S.C. 154(b) by 1019 days.

(21) Appl. No.: 15/561,515

(22) PCT Filed: Mar. 25, 2015

(86) PCT No.: PCT/US2015/022472
§ 371 (c)(1),
(2) Date: Sep. 25, 2017

(87) PCT Pub. No.: WO2016/153502
PCT Pub. Date: Sep. 29, 2016

(65) Prior Publication Data

US 2018/0066503 A1 Mar. 8, 2018

(51) Int. Cl.
*E21B 47/008* (2012.01)
*F04D 13/10* (2006.01)
(Continued)

(52) U.S. Cl.
CPC ..... *E21B 47/008* (2020.05); *E21B 43/128* (2013.01); *F04D 13/10* (2013.01); *F04D 15/0088* (2013.01); *F05D 2260/821* (2013.01)

(58) Field of Classification Search
CPC ..... G06F 30/00; G06F 9/455; E21B 47/008; E21B 2200/20; E21B 43/128; F04D 13/10; F04D 15/0088; F05D 2260/821
(Continued)

(56) References Cited

U.S. PATENT DOCUMENTS 6,131,660 A 10/2000 Stuebinger et al.
6,167,965 B1 1/2001 Bearden et al.
(Continued)

FOREIGN PATENT DOCUMENTS

RU 2 338 875 C2 11/2008

OTHER PUBLICATIONS

G.H. Aggrey et al., "Tracking the state and diagnosing downhole permanent sensors in intelligent-well completions with artificial neural network," 2007, Society of Petroleum Engineers, 10 pages (Year: 2007).*

(Continued)

*Primary Examiner* — Cedric Johnson
(74) *Attorney, Agent, or Firm* — Crowe & Dunlevy, P.C.

(57) ABSTRACT

A virtual sensor system includes one or more electric submersible pumping systems deployed in a reservoir and a computer system that receives data from the one or more electric submersible pumping systems. Field data is provided to computerized statistical models for predicting whether individual electric submersible pumping systems and the reservoir have undergone changes in condition. The statistical models are established with reference data obtained by running electric submersible pumping systems of known working condition in test wells under a variety of controlled conditions.

15 Claims, 6 Drawing Sheets

(51) Int. Cl.
*F04D 15/00* (2006.01)
*E21B 43/12* (2006.01)

(58) Field of Classification Search
USPC ..... 703/10, 6
See application file for complete search history.

(56) References Cited

U.S. PATENT DOCUMENTS 7,658,227 B2 2/2010 Fox et al.
7,979,240 B2 7/2011 Fielder
8,082,217 B2 12/2011 Crossley et al.
8,527,219 B2 9/2013 Camilleri
2003/0015320 A1* 1/2003 Crossley ..... E21B 47/008 166/250.15
2007/0175633 A1 8/2007 Kosmala et al.
2007/0252717 A1* 11/2007 Fielder ..... E21B 47/008 340/648
2008/0270328 A1* 10/2008 Lafferty ..... E21B 47/00 706/12
2009/0044938 A1* 2/2009 Crossley ..... G05B 23/0243 166/250.15
2010/0325071 A1* 12/2010 Roverso ..... F01N 9/005 706/12
2011/0071966 A1* 3/2011 Holley ..... E21B 47/001 706/12
2012/0072029 A1* 3/2012 Persaud ..... G06N 5/04 700/276
2013/0024166 A1* 1/2013 Herzog ..... G05B 23/0254 703/2
2013/0175030 A1 7/2013 Ige et al.
2014/0039836 A1* 2/2014 Moricca ..... E21B 43/12 702/184
2014/0067892 A1* 3/2014 Bishop ..... G06F 17/18 708/446
2014/0214325 A1 7/2014 Wessling et al.
2016/0217379 A1* 7/2016 Patri ..... G06N 20/00
2016/0290077 A1* 10/2016 Aske ..... E21B 34/06
2017/0089192 A1* 3/2017 Rendusara ..... F04D 15/0077
2017/0107989 A1* 4/2017 Coste ..... F04D 13/10
2017/0122094 A1* 5/2017 Chugunov ..... F04D 15/0088

OTHER PUBLICATIONS

Bruno O.S. Teixeira et al., "Data-driven soft sensor of downhole pressure fora gas-lift oil well," 2013, Control Engineering Practice, vol. 22, pp. 34-43 (Year: 2013).*
Dan Sui et al., "Ensemble methods for process monitoring in oil and gas industry operations," 2011, Journal of Natural Gas Science and Engineering, vol. 3, pp. 748-753 (Year: 2011).*
I.G. Main et al., "The statistical reservoir model: calibrating faults and fractures, and predicting reservoir response to water flood," 2007, The Geological Society of London, 14 pages (Year: 2007).*
Fatai Anifowose et al., "Improving the prediction of petroleum reservoir characterization with a stacked generalization ensemble model of support vector machines," Oct. 2014, Applied Soft Computing, vol. 26, pp. 483-496 (Year: 2014).*
Hesam Komari Alaei et al., "Design of new soft sensors based on PCA, genetic algorithm and neural network for parameters estimation of a petroleum reservoir," 2011, 2nd International Conference on Control, Instrumentation and Automation, 5 pages (Year: 2011).*
McLean D., "Using expert systems technology as a real-time optimization tool", Advanced Process Control Applications for Industry Workshop, 1999. IEEE Industry Applications Society, IEEE, Apr. 29-30, 1999, pp. 15-19, Vancouver, BC.
Al-Jasmi et al.,"ESP "Smart Flow" Integrates Quality and Control Data for Diagnostics and Optimization in Real Time",2013 SPE Digital Energy Conference and Exhibition, OnePetro, Mar. 5-7, 2013, The Woodlands, TX, USA.
Office Action and Search issued in connection with corresponding RU Application No. 2017133002 dated Sep. 27, 2018 (Translation not available).

* cited by examiner

SYSTEM AND METHOD FOR RESERVOIR MANAGEMENT USING ELECTRIC SUBMERSIBLE PUMPS AS A VIRTUAL SENSOR

FIELD OF INVENTION

Embodiments of the invention relate generally to the field of data management systems, and more particularly to a process and system for monitoring the condition of a reservoir and the condition of oilfield equipment deployed in the reservoir.

BACKGROUND

Electric submersible pumping systems are often deployed into wells to recover petroleum fluids from subterranean reservoirs. Typically, a submersible pumping system includes a number of components, including one or more electric motors coupled to one or more pump assemblies. Electric submersible pumping systems have been deployed in a wide variety of environments and operating conditions.

In the past, it has been difficult to accurately and rapidly detect changes in the conditions within the reservoir. Once production has begun, operators have looked primarily at the volume of the petroleum output from the reservoir as an indicator for the health of the reservoir. Subtle changes to reservoir conditions are often undetected using previously available practices. The failure to identify changes in the reservoir can lead to inefficient operation and damage to electric submersible pumping systems.

The high cost of repairing and replacing components within an electric submersible pumping system necessitates the use of durable components that are capable of withstanding the inhospitable downhole conditions. Information about the failure of components in the past can be used to improve component design and provide guidance on best operating practices. Using failure rate information, manufacturers have developed recommended operating guidelines and approved applications for downhole components. Manufacturers often place sensors within an electric submersible pumping system and compare measured environmental and performance factors against a range of predetermined set points based on past failure rate information. If an "out-of-range" measurement is made, alarms can be used to signal that a change in operating condition should be made to reduce the risk of damage to the electric submersible pumping system. Although generally effective for identifying concerns in individual pumping systems following an out-of-range incident, there is a need for an improved system for evaluating the health of electric submersible pumping systems distributed across a wide area and deployed in varying applications. It is to these and other deficiencies in the prior art that the presently preferred embodiments are directed.

SUMMARY OF THE INVENTION

Embodiments of the present invention include a system that includes one or more electric submersible pumping systems deployed in a reservoir and a computer system that receives data from the one or more electric submersible pumping systems. Through computerized statistical modeling, the system outputs a prediction about whether individual electric submersible pumping systems and the reservoir have undergone changes in condition. In this sense, the electric submersible pumping systems act as "virtual sensors" by providing field data field to the statistical models, which can then be used to predict the condition of the individual electric submersible pumping systems and the condition of the reservoir.

In one aspect, the preferred embodiments include a process for predicting changes in an electric submersible pumping system deployed in a reservoir. The process begins with the step of establishing a reference library of baseline data. The baseline data is representative of electric submersible pumping systems in known working order under a variety of reservoir conditions. The process continues with the step of developing a reservoir state model, where the reservoir state model is based at least in part on the baseline data. Next, the process includes the step of developing an electric submersible pumping system anomaly model that is based at least in part on the baseline data. The process continues with the steps of receiving field data from the electric submersible pumping system deployed in the reservoir and applying the field data to the reservoir state model and electric submersible pumping system anomaly model. The process concludes by generating an output representative of the likelihood that the reservoir has changed states.

In another aspect, the preferred embodiments include a computerized process for predicting changes in a subterranean reservoir. The process includes the steps of establishing a reference library of baseline data, creating a reservoir state statistical model in a computer based at least in part on the baseline data library and acquiring field data from one or more electric submersible pumping systems deployed in the subterranean reservoir. The process continues with the steps of applying the field data to the reservoir state statistical model to determine a most likely reservoir state result, comparing the most likely reservoir state result against the baseline data library and generating an output that expresses the likelihood that the reservoir has changed.

In yet another aspect, the preferred embodiments include a computerized process for predicting changes in electric submersible pumping systems deployed within a subterranean reservoir. The process begins with the step of establishing a reference library of baseline data, wherein the baseline data is collected by operating one or more electric submersible pumping systems of known condition in one or more test wells under controlled conditions. The process continues with the steps of creating an electric submersible pumping system anomaly statistical model in a computer based at least in part on the reference library, acquiring field data from one or more electric submersible pumping systems deployed in the subterranean reservoir and applying the field data to the electric submersible pumping system anomaly statistical model. The process concludes with the step of generating an output that expresses the likelihood that the one or more electric submersible pumping systems is operating in an anomalous condition.

DETAILED DESCRIPTION

Generally, the preferred embodiments are directed at an improved system and methodology for using sensor data from electric submersible pumping systems to monitor health of individual electric submersible pumping systems and also changes to the reservoirs in which electric submersible pumping systems are installed. The preferred embodiments represent an advancement over the prior art for a number of reasons, including that the systems and methods are capable of simultaneously monitoring and predicting changes in reservoir conditions and conditions within individual electric submersible pumping systems. The preferred embodiments include measuring the operation and condition of components within a discrete electric submersible pumping system, accumulating these measurements across a field of electric submersible pumping systems, performing statistical analysis on the accumulated measurements and producing one or more selected outputs from the group statistical analysis. As used herein, the term "health indices" refers to an expression of the condition of components within an electric submersible pumping system, where the condition is determined by an assessment of data produced by sensors within a particular electric submersible pumping system.

Figure 1:
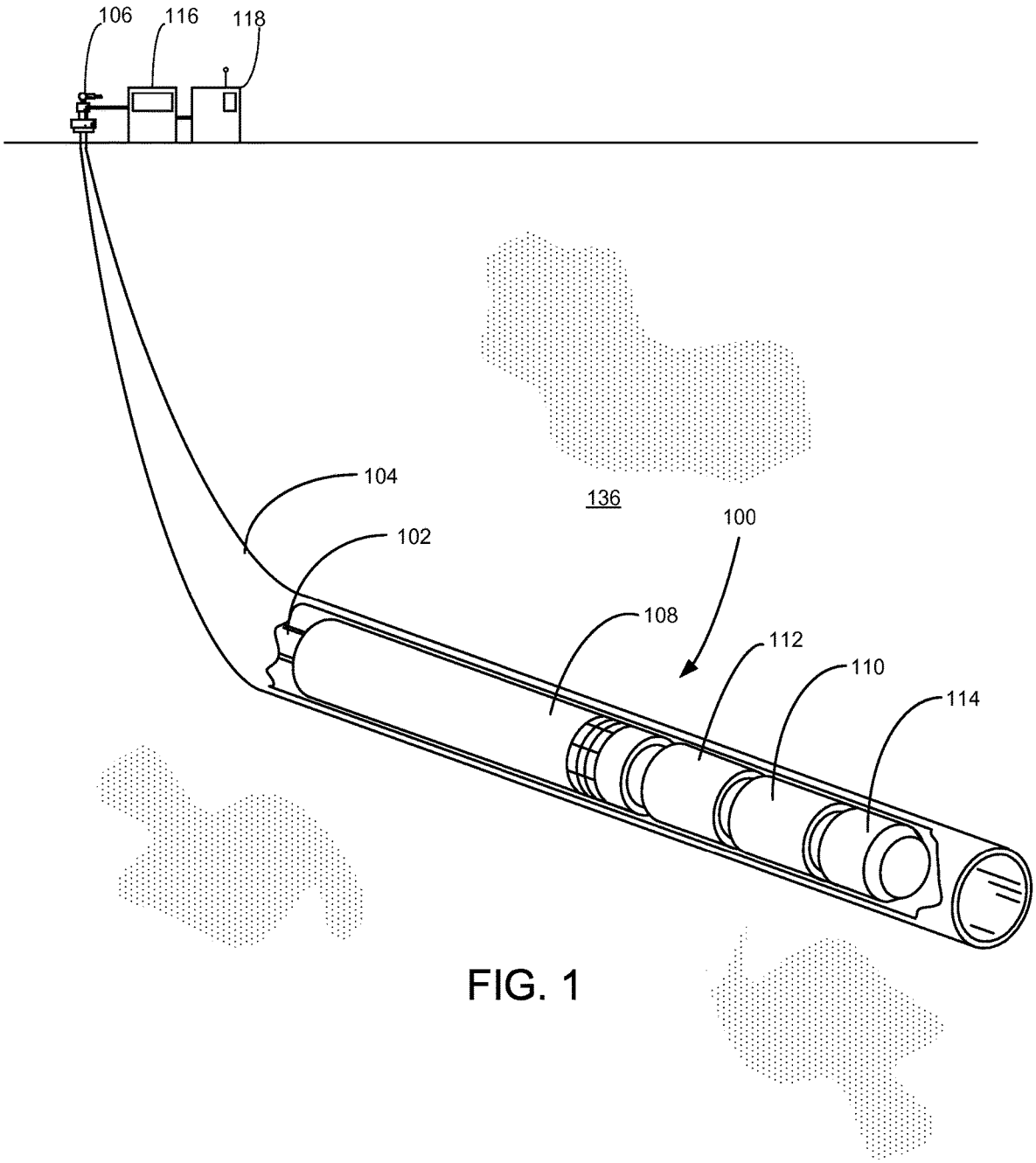
FIG. 1 is a depiction of an electric submersible pumping system constructed in accordance with a presently preferred embodiment.

In accordance with an embodiment of the present invention, FIG. 1 shows an elevational view of a submersible pumping system 100 attached to production tubing 102. The pumping system 100 and production tubing 102 are disposed in a wellbore 104, which is drilled for the production of a fluid such as water or petroleum. The production tubing 102 connects the pumping system 100 to a wellbore 106 and downstream surface facilities (not shown). Although the pumping system 100 is primarily designed to pump petroleum products, it will be understood that embodiments the present invention can also be used to move other fluids. It will be further understood that the depiction of the wellbore 104 is illustrative only and the presently preferred embodiments will find utility in wellbores of varying depths and configurations.

The pumping system 100, in an embodiment, includes some combination of a pump assembly 108, a motor assembly 110, a seal section 112 and a sensor array 114. The pump assembly 108 is, in an embodiment, configured as a multi-stage centrifugal pump that is driven by the motor assembly 110. The motor assembly 110 is, in an embodiment, configured as a three-phase electric motor that rotates an output shaft in response to the application of electric current at a selected frequency. In a particularly preferred embodiment, the motor assembly 110 is driven by a variable speed drive 116 positioned on the surface. Electric power is conveyed from the variable speed drive 116 to the motor assembly 110 through a power cable.

The seal section 112 shields the motor assembly 110 from mechanical thrust produced by the pump assembly 108 and provides for the expansion of motor lubricants during operation. Although only one of each component is shown, it will be understood that more can be connected when appropriate. For example, in many applications, it is desirable to use tandem-motor combinations, multiple seal sections and multiple pump assemblies. It will be further understood that the pumping system 100 may include additional components, such as shrouds and gas separators, not necessary for the present description.

Figure 2:
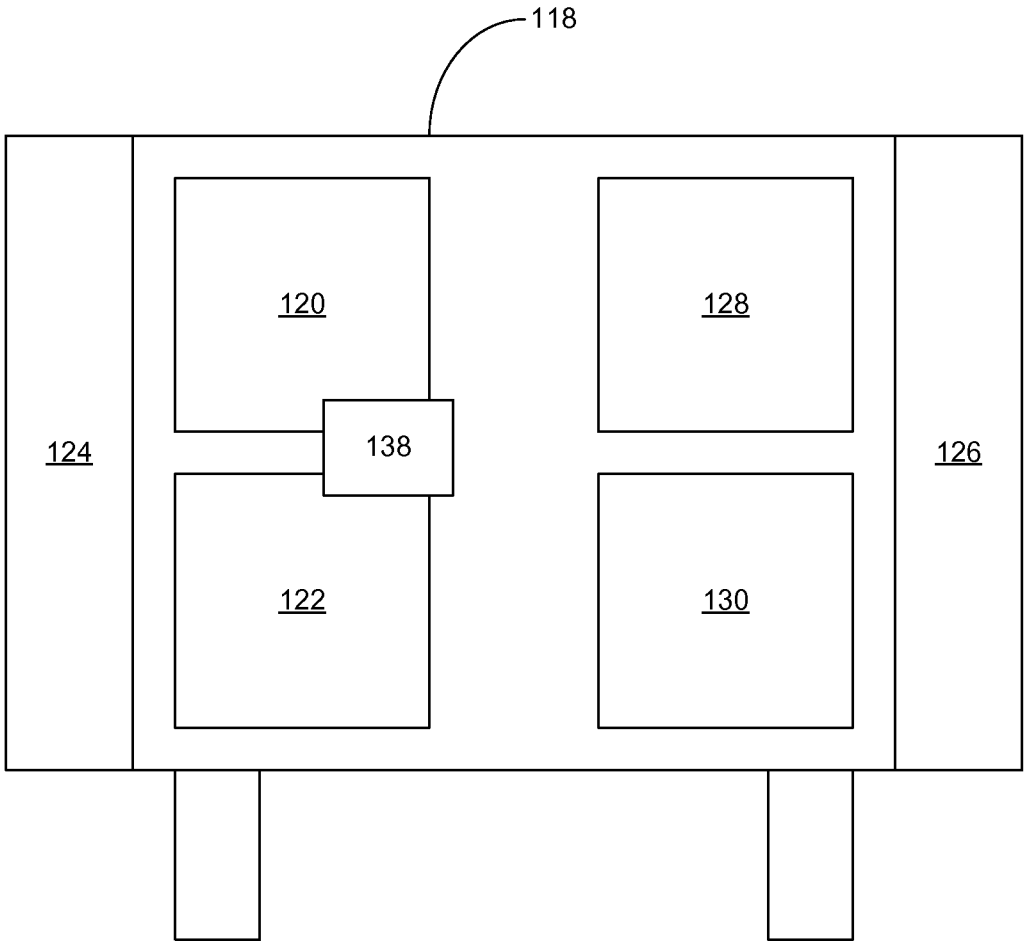
FIG. 2 is a functional depiction of the local control unit of the electric submersible pumping system of FIG. 1.

The pumping system 100, in an embodiment, includes a local control unit 118 connected to the variable speed drive 116. Turning to FIG. 2, shown therein is a functional depiction of the local control unit 118. The local control unit 118, in an embodiment, includes a data storage device 120, a central processing unit 122, a controls interface 124 and a communications module 126. The local control unit 118 optionally includes a graphic display 128 and user input device 130. In presently preferred embodiments, the local control unit 118 includes one or more computers and accompanying peripherals housed within a secure and environmentally resistant housing or facility.

The controls interface 124 is configured for connection to the variable speed drive 116 and directly or indirectly to the sensor array 114. The controls interface 124 receives measurements from the wellbore 104 and the various sensors within the electric submersible pumping system 100. The controls interface 124 outputs control signals to the variable speed drive 116 and other controllable components within the electric submersible pumping system 100.

The central processing unit 122 is used to run computer programs and process data. The computer programs, raw data and processed data can be stored on the data storage device 120. In particular, the central processing unit 122 is configured to determine health indices and other performance metrics for the pumping system 100 in accordance with preferred embodiments. The user input device 130 may include keyboards or other peripherals and can be used to manually enter information at the local control unit 118. The communications module 126 is configured to send and receive data. The communications module 126 may be configured for wireless, wired and/or satellite communication.

Figure 3:
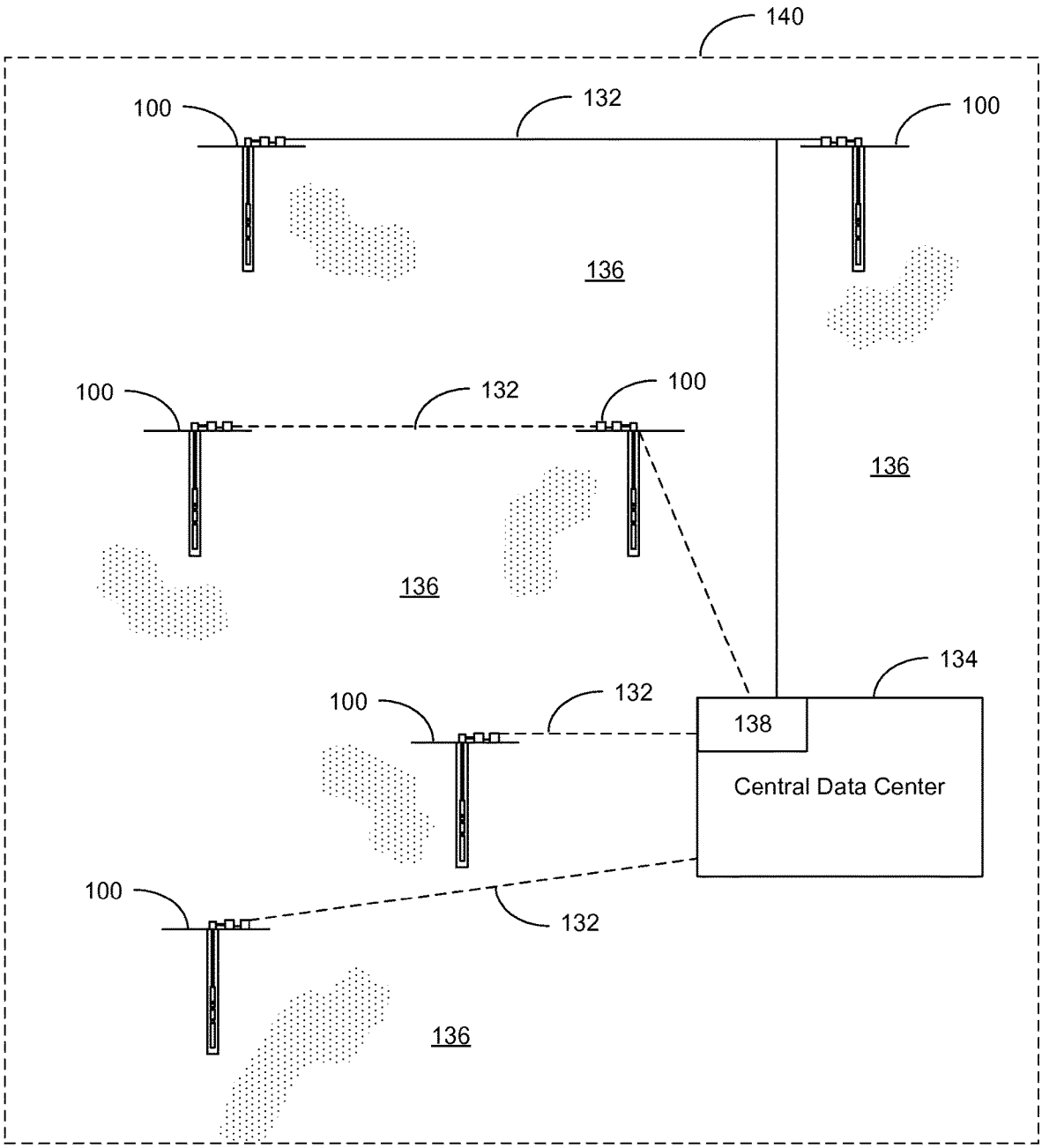
FIG. 3 is a functional diagram of a series of electric submersible pumping systems in network connectivity with a central data center.

As depicted in FIG. 3, a plurality of electric submersible pumping systems 100 may be deployed within a common reservoir 136. The communications module 126 places the local control unit 118 and electric submersible pumping system 100 on a network 132. The network 132 may include a multi-nodal system in which discrete electric submersible pumping systems 100 may within the reservoir 136 act as both repeater and terminal nodes within the network 132. Whether through wired or wireless connection, each of the electric submersible pumping systems 100 are placed in two-way network connectivity to one or more central data centers 134. It will be understood that there are a wide range of available configurations encompassed by the preferred embodiment of the network 132.

Figure 4:
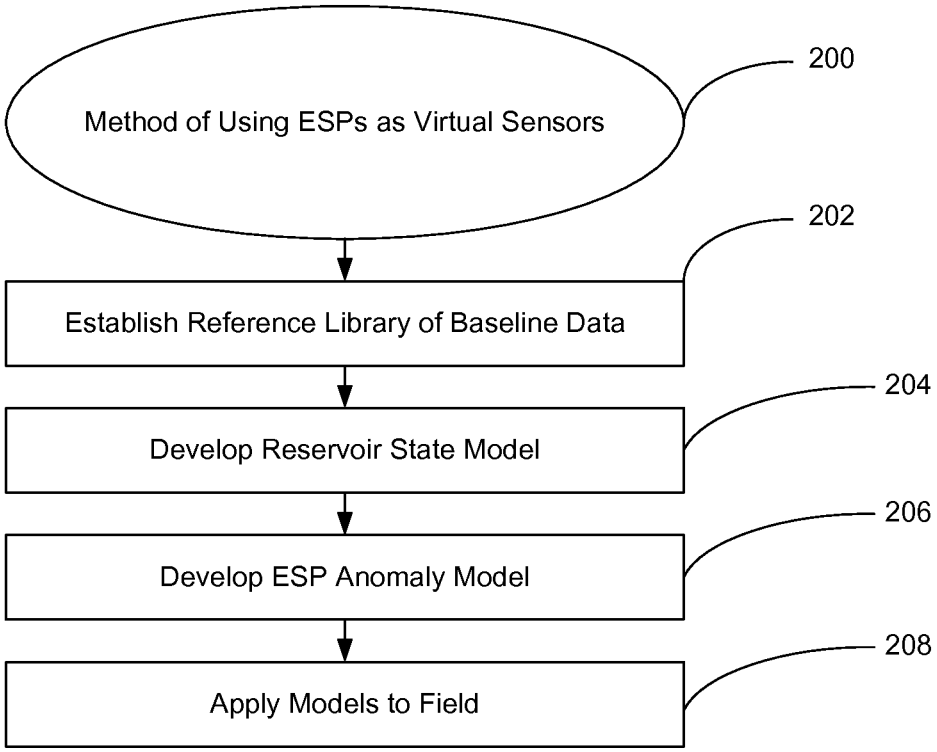
FIG. 4 is a process flow diagram for a preferred method of using electric submersible pumping systems as virtual sensors.

Turning to FIG. 4, shown therein is a process flow diagram for a preferred embodiment of a method 200 of using electric submersible pumping systems 100 as virtual sensors. As used herein, the phrase "virtual sensor" will be understood to refer to the analytical and predictive use of data produced by one or more electric submersible pumping systems 100 for evaluating changing conditions within an electric submersible pumping system 100 or within a reservoir or field. It will be appreciated that the method 200 relies on the creation and deployment of analytical models that are, in an embodiment, automated as computer software that resides and operates on one or more computer systems 138 located at the central data center 134, in the reservoir 136 or at both the central data center 134 and the reservoir 136. The software models, computer systems 138 and electric submersible pumping systems 100 collectively define a virtual sensor network 140 (shown in FIG. 3) configured to monitor the condition of the electric submersible pumping systems 100 and reservoir 136.

The method 200, in an embodiment, includes four stages: developing a reference library of baseline data at stage 202, developing a reservoir state model stage step 204, developing an electric submersible pumping system anomaly model at stage 206 and applying the reservoir state model and electric submersible pumping system anomaly model to the field at stage 208. Presently preferred embodiments of the steps within each of these stages are illustrated in FIGS. 5-8.

Figure 5:
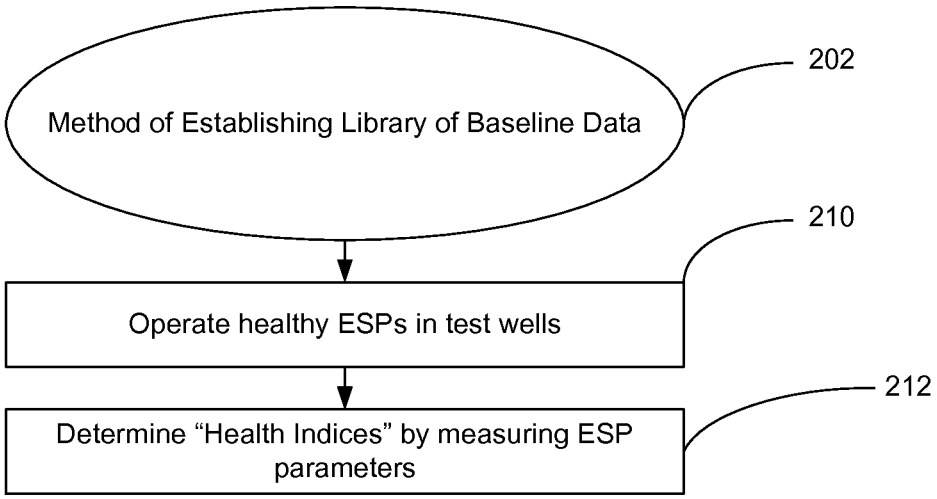
FIG. 5 is a process flow diagram for a preferred method of establishing a library of baseline data.

Turning to FIG. 5, shown therein is a preferred embodiment of the stage 202 for establishing a reference library of baseline or "truth" data. The reference library of baseline data is established to act as a benchmark derived under controlled conditions. The stage begins at step 210 by operating a one or more healthy electric submersible pumping systems 100 in one or more test wells under a range of prescribed reservoir conditions. In a particularly preferred embodiment, the prescribed range of reservoir conditions include, but are not limited to, downhole fluid pressure, fluid viscosity, gas-to-oil ratio, water-to-oil ratio, fraction of solid contaminants, and radiation levels, which are measured as control variables.

At step 212, the corresponding high-frequency time series of parameters for the electric submersible pumping systems 100 undergoing the tests are measured and stored for each test setting. Measured parameters include, but are not limited to, static fluid pressure, flowing fluid pressure, three-phase current, three-phase voltage, vibration, speed and phase angle. The measured and stored parameters are denoted as electric submersible pumping system "health indices" that can be expressed as a function of the reservoir variables. The "health indices" determined as a result of the tests conducted on healthy electric submersible pumping systems 100 provide a library of reference data across a range of reservoir conditions. This reference library data provides the basis for developing the reservoir state model at stage 204 and the electric submersible pumping system anomaly model at stage 206.

Figure 6:
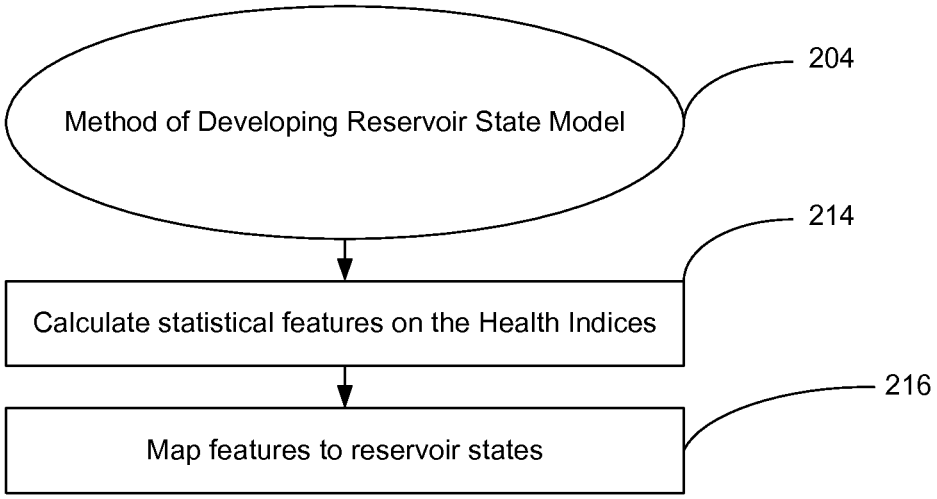
FIG. 6 is a process flow diagram for a preferred method of developing a reservoir state model.

Turning to FIG. 6, shown therein is a preferred embodiment of the stage 204 for developing a reservoir state model. At step 214, a variety of statistical features are calculated on the health indices derived at stage 202. These calculations may include time domain features and frequency domain features. In particularly preferred embodiments, the time domain analysis may include the use of average, standard deviation, skewness, kurtosis, RMS, crest factor percentiles and joint parametric and non-parametric distributions. In particularly preferred embodiments, the frequency domain analysis may include the use of Fourier transforms, power spectral density, first four moments of the spectral density and wavelet coefficients. It will be appreciated that other statistical calculations may be performed to obtain time domain and frequency domain features.

At step 216, the features calculated at step 214 are correlated or "mapped" onto the corresponding reservoir states evaluated during the stage 202 of establishing a reference library. In a particularly preferred embodiment, the features are mapped onto the corresponding reservoir states using ensemble machine learning algorithms. Suitable machine learning algorithms include, but are not limited to a combination of random forest models, support vector machines and logistic regression classifiers. Mapping the features onto the corresponding reservoir states creates reservoir state models across a range of reservoir conditions.

The stage 204 of developing a reservoir state model optionally includes the steps of identifying and classifying critical features. Critical features are identified as those features that are most strongly associated with a change in the state of the reservoir 136. In a particularly preferred embodiment, the critical features are identified using variable importance charts based on Gini coefficients. The variable importance charts track the critical features that contain the most diagnostic information for each state.

Figure 7:
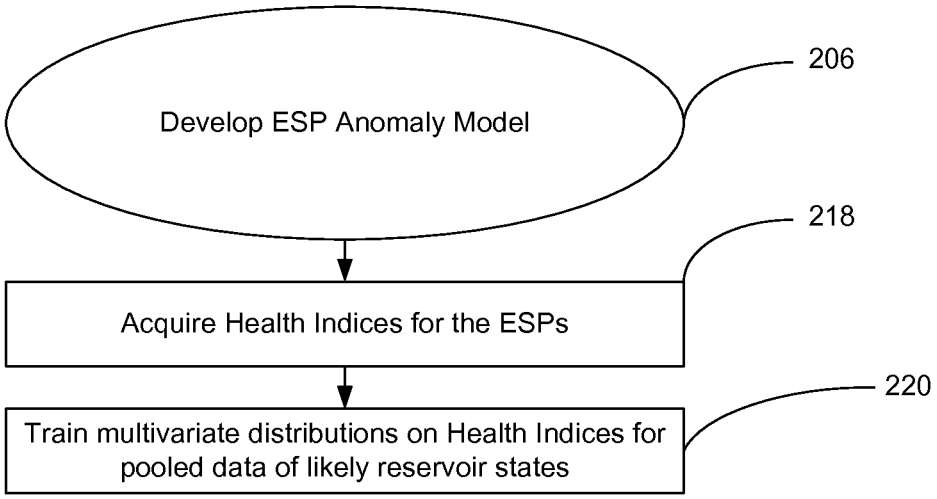
FIG. 7 is a process flow diagram for a preferred method of developing an electric submersible pumping system anomaly model.

The method 200 of using electric submersible pumping system as virtual sensors continues at stage 206 by developing an electric submersible pumping system anomaly model. Turning to FIG. 7, shown therein are the preferred steps within the stage 206 of developing an electric submersible pumping system anomaly model. The stage begins at step 218 by acquiring the health indices determined in stage 202. At step 220, multivariate mixture distributions are trained on the health indices for the pooled data made up of likely or expected reservoir states. In a particularly preferred embodiment, the mixture distributions can be established using mixture Gaussian techniques, estimated using expectation maximization techniques, or estimated using non-parametric kernel density methods. The models produced by the multivariate mixture distributions are used to determine if a particular electric submersible pumping system 100 is malfunctioning, broken or otherwise compromised.

Figure 8:
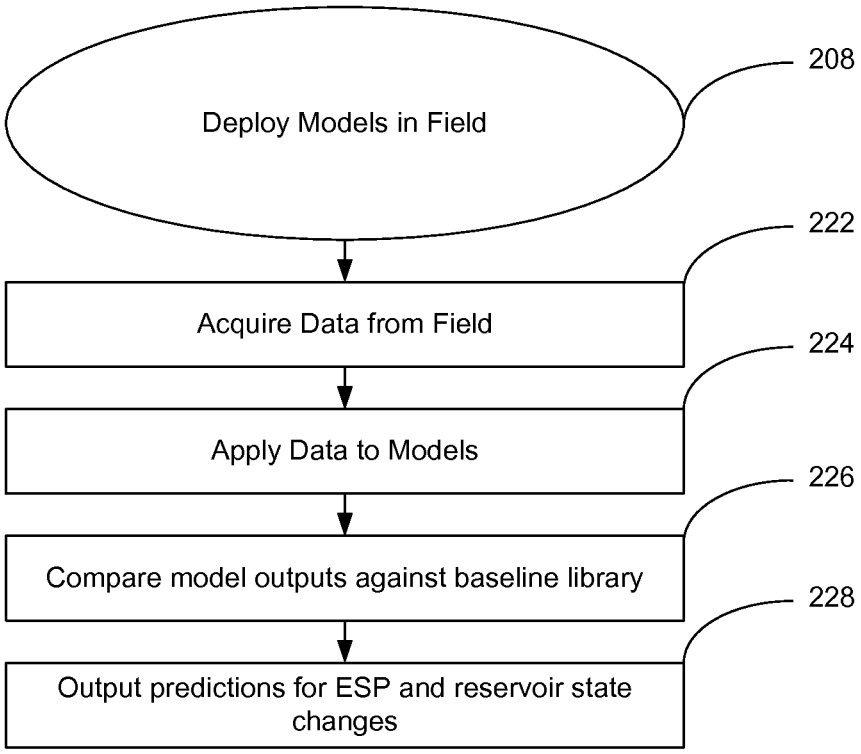
FIG. 8 is a process flow diagram for deploying the reservoir state and electric submersible pumping system anomaly models in the field.

When the reference library of baseline data, reservoir state model and electric submersible pumping system anomaly model have been created and integrated into the computer systems 138, the virtual sensor network 140 can be placed into operation. The stage of deploying models to the field 208 of the method 200 is illustrated in FIG. 8. At step 222, the computer systems 138 within the virtual sensor network 140 acquire from the electric submersible pumping systems 100 on a continuous or periodic basis field data representative of conditions in the wellbore 104 and within the electric submersible pumping system 100.

Next, at step 224, the field data is applied to the reservoir state and electric submersible pumping system anomaly models. In a preferred embodiment, the data is applied to the models on a periodic basis through a series of tests. In a particularly preferred embodiment, the tests begin by running the mixture distribution determined at step 220 to calculate the probability of a sensor data vector being anomalous. In the preferred embodiments, the identification of an anomalous condition is not triggered until the probability of the sensor data vector being anomalous exceeds a preset threshold. During the next test, the field data within the sensor vector is compared to the library of known reservoir states using similarity measures. In a particularly preferred embodiment, the comparison of the field data against the reservoir state model is conducted using Cosine or Parzen similarity functions. During the last test, the comparative analysis of the field data is also used to classify the reservoir 136 into a most likely reservoir state using the ensemble model. It will be appreciated that additional or fewer tests may be conducted at step 224.

Once the tests have been concluded, the stage of deploying the models to the field 208 continues at step 226 by comparing the results of the tests against the baseline data library using a truth table or logic rule to determine the likelihood that: (1) the reservoir 136 has changed state; (2) the electric submersible pumping system 100 has become faulty or is otherwise operating outside an expected condition; or (3) both the reservoir 136 and the electric submersible pumping system 100 have changed from the baseline state. The stage of deploying the models to the field 208 concludes at step 228 by outputting a prediction to the operator that a state change has occurred in the reservoir 136 or electric submersible pumping system 100. The prediction can be presented to the operator in any suitable format, including printed reports and computer-displayed charts and spreadsheets. Notably, the prediction about whether a particular electric submersible pumping system 100 has undergone a change in condition may precede the actual failure of the electric submersible pumping system 100. The prediction of state changes at individual electric submersible pumping systems 100 and of changes to the reservoir 136 can be used by the operator to schedule preventive maintenance, modify operating parameters of the electric submersible pumping systems 100 and adjust economic forecasts based on the state of the reservoir 136.

Thus, the preferred embodiments provide a virtual sensor system 140 that includes one or more electric submersible pumping systems 100 deployed in a reservoir 136 and a computer system 138 that receives data from the one or more electric submersible pumping systems 100 and through computer modeling outputs a prediction about whether individual electric submersible pumping systems 100 and the reservoir 136 have undergone changes in condition. The process of generating baseline models and using sensor data from the electric submersible pumping systems 100 to predict actual or future state change of the electric submersible pumping system 100 presents a significant advancement over the prior art methodology that relies on reactive alarms that are only triggered after a failure has occurred. The use of the probability models disclosed herein also permits the prediction of the state changes within the reservoir 136.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention. For example, although the preferred embodiments are described in connection with electric submersible pumping systems, it will be appreciated that the novel systems and methods disclosed herein can find equal applicability to other examples of groups of distributed equipment within a common environment. The novel systems and methods disclosed herein can be used to monitor, evaluate and optimize the performance of fleet vehicles, natural gas compressors, refinery equipment and other remotely disposed industrial equipment.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It is claimed:

1. A process for predicting changes in an electric submersible pumping system deployed in a reservoir, the process comprising the steps of:

establishing a reference library of baseline data, wherein the baseline data is representative of electric submersible pumping systems in good working order under a variety of reservoir conditions, wherein the step of establishing a reference library of baseline data further comprises the steps of:

providing an electric submersible pumping system in known good working order, operating the electric submersible pumping system in a test well under a range of prescribed reservoir conditions that are representative of known reservoir states, measuring high-frequency time series of parameters for the electric submersible pumping system operating in the test well, and storing the measurements for each test as health indices, wherein the health indices represent the condition of the electric submersible pumping system;

developing a reservoir state model, wherein the reservoir state model is based at least in part on the baseline data, wherein the step of developing a reservoir state model further comprises calculating a plurality of statistical features on the health indices;

developing an electric submersible pumping system anomaly model, wherein the electric submersible pumping system anomaly model is based at least in part on the baseline data, wherein the step of developing an electric submersible pumping system anomaly model further comprises the steps of:

acquiring the health indices, and training multivariate mixture distributions on the health indices for pooled data made up of expected reservoir states;

receiving field data from the electric submersible pumping system deployed in the reservoir;

applying the field data to the reservoir state model and electric submersible pumping system anomaly model;

generating an output representative of the likelihood that the reservoir has changed states; and generating an output representative of the likelihood that the electric submersible pumping system has changed states.

2. The process of claim 1, wherein the step of operating the electric submersible pumping system in a test well under a range of prescribed reservoir conditions further comprises operating the electric submersible pumping system in a test well under a range of prescribed reservoir conditions selected from the group consisting of downhole fluid pressure, fluid viscosity, gas-to-oil ratio, water-to-oil ratio, fraction of solid contaminants and radiation levels.

3. The process of claim 1, wherein the step of measuring high-frequency time series of parameters further comprises measuring parameters selected from the group consisting of static fluid pressure, flowing fluid pressure, three-phase current, three-phase voltage, vibration, speed and phase angle.

4. The process of claim 1, wherein the step of calculating a plurality of statistical features further comprises calculating a plurality of time domain features and frequency domain features.

5. The process of claim 4, wherein the step of calculating a plurality of time domain features further comprises calculating a plurality of time domain features using techniques selected from the group consisting of average, standard deviation, skewness, kurtosis, RMS, crest factor percentiles and joint parametric and non-parametric distributions.

6. The process of claim 4, wherein the step of calculating a plurality of frequency domain features further comprises calculating a plurality of frequency domain features using techniques selected from the group consisting of Fourier transforms, power spectral density, first four moments of the spectral density and wavelet coefficients.

7. The process of claim 1, wherein the step of developing a reservoir state model further comprising the step of correlating the calculated statistical features onto the corresponding reservoir states.

8. The process of claim 7, wherein the step of correlating the calculated statistical features onto the corresponding reservoir states further comprises correlating the calculated statistical features onto the corresponding reservoir states using ensemble machine learning algorithms.

9. The process of claim 8, wherein the step of using ensemble machine learning algorithms further comprises using ensemble machine learning algorithms selected from the group consisting of random forest models, support vector machines and logistic regression classifiers.

10. The process of claim 7, wherein the step of developing a reservoir state model further comprises the steps of identifying and classifying critical statistical features, wherein the critical statistical features are selected as those statistical features that are most strongly associated with a change in the state of the reservoir.

11. The process of claim 10, wherein the steps of identifying and classifying critical features further comprises identifying critical features using variable importance charts based on Gini coefficients.

12. The process of claim 1, wherein the step of training multivariate mixture distributions further comprises applying multivariate mixture distributions selected from the group of techniques consisting of mixture Gaussian, estimated using expectation maximization, and non-parametric kernel density.

13. The process of claim 1, wherein the step of receiving field data from the electric submersible pumping system deployed in the reservoir further comprises receiving field data from a plurality of electric submersible pumping systems deployed within the reservoir.

14. The process of claim 13, wherein the step of applying the field data to the reservoir state model and electric submersible pumping system anomaly model further comprises:

running the mixture distribution to calculate the probability of the field data being anomalous;

comparing the field data to the library of known reservoir states using similarity measures; and classifying the reservoir into a most likely reservoir state using an ensemble model based on the field data.

15. The process of claim 14, wherein the step of applying the field data to the reservoir state model and electric submersible pumping system anomaly model further comprises comparing the outputs of the application of field data to the reservoir state model and electric submersible pumping system anomaly model with the baseline data.

* * * * *